US005339881A

United States Patent [19]

Owens

[11] Patent Number: 5,339,881

[45] Date of Patent: Aug. 23, 1994

[54] ELECTRICALLY OPERATED DROP SEAL FOR OPERABLE WALLS

[75] Inventor: N. Douglas Owens, Lynn, Ind.

[73] Assignee: Modernfold, Inc., New Castle, Ind.

[21] Appl. No.: 27,376

[22] Filed: Mar. 8, 1993

[51] Int. Cl.[5] ..... E06B 7/16

[52] U.S. Cl. ..... 160/40; 49/316; 49/411

[58] Field of Search ..... 160/40, 199, 188, 94, 160/224, 206; 49/411, 410, 316

[56] References Cited

U.S. PATENT DOCUMENTS

| | | | |
|---|---|---|---|
| 2,987,121 | 6/1961 | Haws | 160/40 X |
| 3,086,261 | 4/1963 | Lapof | 160/40 X |
| 3,098,519 | 7/1963 | Myers et al. | 160/199 X |
| 3,126,050 | 3/1964 | Lapof | 160/40 |
| 4,880,046 | 11/1989 | Gesy | 160/40 X |

OTHER PUBLICATIONS

Acousti-Seal 900 Series Technical Data brochure, Modernfold, Inc. Form No. 2153R4, 1991.

*Primary Examiner*—David M. Purol

*Attorney, Agent, or Firm*—Baker & Daniels

[57] ABSTRACT

A drop seal assembly for a movable wall panel, the wall panel being situated in a room having a ceiling and a floor such that the wall panel is supported from the ceiling and is suspended above the floor. The drop seal includes a motor and an actuator operatively connected to the motor and movable between a first actuator position and a second actuator position in response to the operation of the motor. The drop seal also includes a mechanism, such as a compression spring, connected to the actuator and a retractable seal connected to the spring such that when the actuator is in its first position, the seal does not engage the floor, and when the actuator is in its second position, the seal engages the floor, the spring biasing the seal toward the floor to effectively seal the panel against the floor.

21 Claims, 5 Drawing Sheets

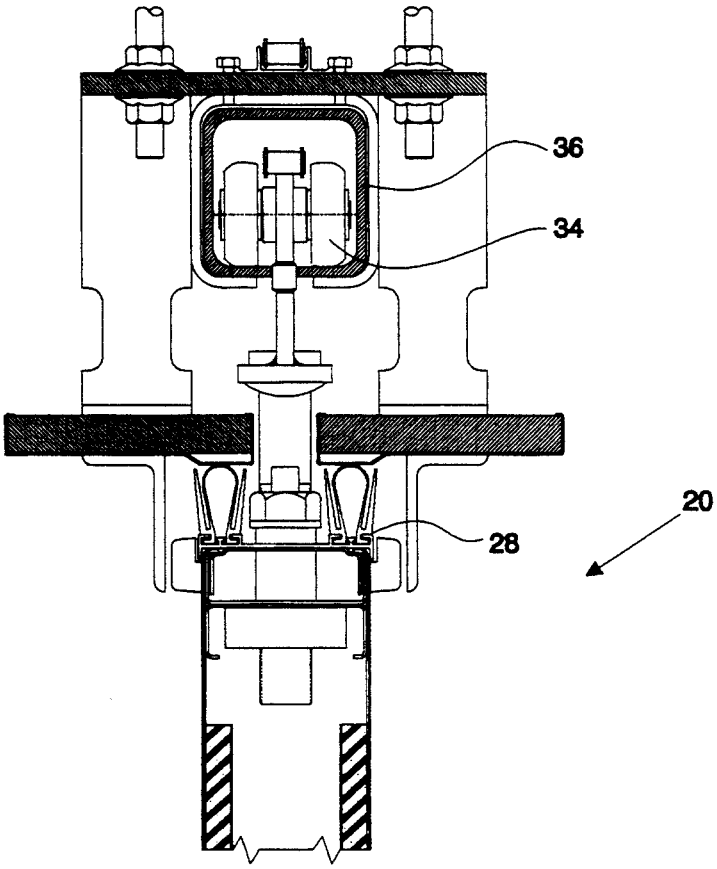
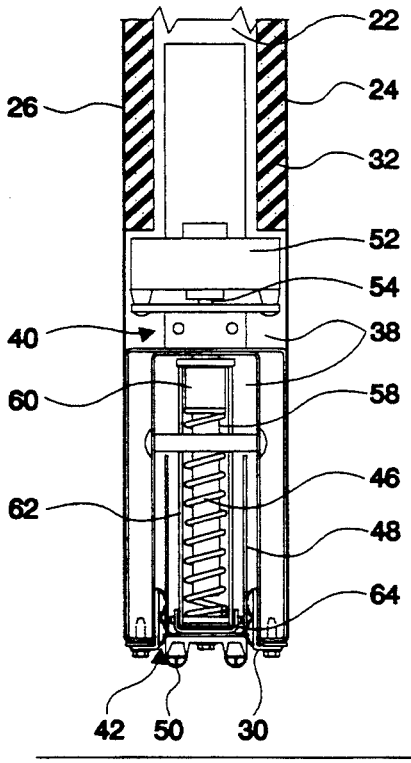
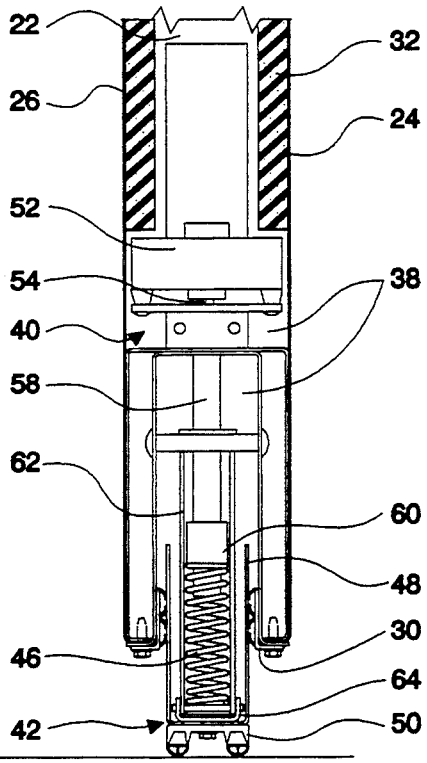
*Fig. 1*
*Fig. 2*

ELECTRICALLY OPERATED DROP SEAL FOR OPERABLE WALLS

FIELD OF THE INVENTION

This invention relates to movable wall panels, and, in particular, to an electrically actuated drop seal which forms a seal between the wall panel and the floor above which the wall panel is suspended.

DESCRIPTION OF THE RELATED ART

Movable wall panels, both manually and electrically operated, have found application in many areas where it is desirable to divide a room into more than one smaller room. For example, a high school gymnasium may be divided into two sections so that two physical education classes may be held simultaneously in the gymnasium. Also, movable wall panels are used to divide hotel conference rooms and large rooms of convention centers into several smaller areas. In many installations of movable wall panels, it is desirable to provide a sound proof barrier so that individuals in one area are not disturbed by sound emanating from another area. Further, it is desirable to prevent the emanation of light from one area to another as may be necessary should one area be used for video display purposes in which light from another area may impair the view of the video display.

For movable walls hung from a track in the ceiling of the room, a major obstacle in creating such an acoustic and light barrier is the space created between the bottom of the wall panels and the floor over which the panels are suspended. To seal the gap between the bottom of the panels and the floor, at least two types of drop seals are known in the art. The first type of drop seal is a floating seal, such as that available with the Acousti-Seal 900 Series continuously hinged, electrically actuated wall panels offered by Modernfold, Inc. of New Castle, Ind. Floating seals are spring loaded and equipped with casters for hard surfaces or equipped with sliding pucks for carpet surfaces, such that the seal remains in constant contact with the floor as the panels are extended to divide the room into one or more areas and as the panels are retracted. Since these floating seals slide across the floor as the panels are extended and retracted, such seals may leave marks or even cause damage to hardwood surfaces. Such seals may also catch the nap of a carpet to the extent that the seal may even be torn from the panel. Also, regardless of the type of floor surface on which the floating seals rides, because the floor is not exactly parallel to the bottom of the panel and because the force of the seal against the floor is limited due to the fact that the seals are dragged across the floor, the floating seal does not provide a good sound and/or light barrier for such irregular floor surfaces. Therefore, it is desired to provide a drop seal for a movable wall panel system which provides a good sound and light barrier, which does not damage the surface of the floor or the covering over the floor and which is not susceptible to damage when the panels are moved across the floor.

A second type of drop seal, known as an automated drop seal, is actuated when continuously hinged panels are moved into their fully extended position. An example of such an automated seal is available with the Acousti-Seal 900 Series wall system from Modernfold, Inc. Specifically, an automated seal is recessed within the bottom of each movable wall panel and a portion of the seal on the leading panel extends outside of the leading edge of the leading panel. The leading panel automated seal is actuated, lowered, by depression of that portion of the leading seal extending beyond the outside of the leading panel's leading edge. Thus, when continuously hinged panels are moved into their fully extended position, i.e., the panels form a straight line for the division of one room into two distinct areas, the force of the leading panel against the wall causes the seal within that panel to swing downward below the panel's bottom edge to engage the floor. The movement of the leading panel's seal causes actuation of the adjacent seal in the adjacent panel. When moving the panels toward their retracted position or storage position, movement of the leading panel away from the wall causes the drop seals to retract or swing upward away from the floor as the panels are biased toward their retracted position.

Though an "automatic" seal mechanism is provided with such automated drop seals so that the seal need not engage the floor while the panels are moving, the portion of the seal extending from the leading panel is susceptible to damage. Also, considerable force is required to lower all the seals within a continuously hinged system. For an electrically driven movable wall system, this force requirement imposes the need to utilize a large electric motor to force all of the drop seals of the multiple panels against the floor. Further, the force required for automated drop seals practically limits the number of successive panels in a movable wall panel system that utilizes such a seal. Therefore, it is desired to provide a drop seal system which does not include any element which protrudes beyond any part of the wall panel except the panel's bottom edge so that the drop seal system is not susceptible to inadvertent damage. Also, it is desired to provide a drop seal system which does not take a great deal of force to engage the seals of the multiple panel system against the floor and which does not restrict the number of successive panels which utilize such a seal in a movable wall system.

Another problem encountered with the use of both floating seals and automated drop seals is the fact that these types of drop seals are limited in the extent to which the seal may be extended from the bottom edge of the wall panel. Thus, if the distance between the ceiling and the floor changes, as may be caused by settling of the building, warpage of the floor or the presence or absence of a snow load on the ceiling, the drop seals only accommodate relatively small changes, such as 0.5 inches, and may therefore result in a gap between the seal and the floor. For floating seals, this may prohibit the panel from traversing the floor, or, for automatic seals, may not provide enough distance for the drop seal to be lowered. Therefore, it is desired to provide a drop seal system which can accommodate larger changes which occur in the distance between the ceiling and the floor.

SUMMARY OF THE INVENTION

The present invention provides an electrically actuated drop seal assembly for sealing a movable wall panel against the floor over which the panel is suspended.

The invention comprises, in one form thereof, a drop seal assembly for use with a movable wall panel wherein the wall panel is situated in a room having a ceiling and a floor and is supported from the ceiling and suspended above the floor. The drop seal assembly includes a motor, an actuator operatively connected to the motor and movable between a first actuator position and a second actuator position in response to the operation of the motor, a mechanism, such as a spring, connected to the actuator, and a sealing mechanism. The sealing mechanism is operatively connected to the spring such that when the actuator is in its first position, the sealing means does not engage the floor and when the actuator is in its second position, the sealing means engages the floor, the spring biasing the sealing mechanism toward the floor to effectively seal the panel against the floor.

In another form thereof, the invention comprises a movable wall panel having first and second opposing surfaces and top and bottom edges and having the drop seal system of the present invention disposed between the first and second opposing walls proximate the bottom edge of the wall panel such that the drop seal seals the wall panel against the floor.

An advantage of the present invention is the provision of a drop seal which results in an excellent acoustic and light barrier regardless of the type of floor surface and the contour of the floor surface which are engaged by the drop seal.

Another advantage is the provision of a drop seal system which has no components which extend outside the wall panel, other than the bottom edge of the wall panel, to thereby limit the potential damage to the system's components.

Yet another advantage of the present invention is the provision of a drop seal system which does not limit the number of continuously hinged wall panels in a movable wall panel system which utilize such a seal.

Still another advantage of the present invention is the provision of a drop seal system which is functional despite changes in the distance between the ceiling from which the panel is hung to the floor which the drop seal is to engage.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 1 shows a partial cross-sectional view of a movable wall panel having the drop seal system according to the present invention in which the drop seal is in its retracted, or first, position;

FIG. 2 shows a partial cross-sectional view of the embodiment of FIG. 1 in which the drop seal is in is extended, or second, position;

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION

Figure 4:
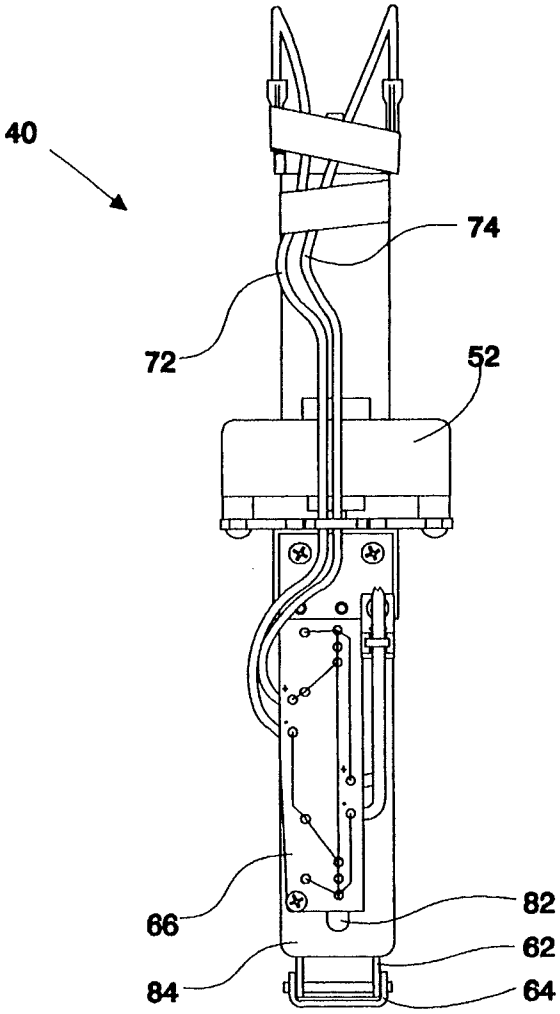
FIG. 4 shows a rear view of the drop seal system of the embodiment of FIGS. 1–3.

Referring now to FIG. 1, there is shown a partial cross-sectional view of a movable wall panel having the drop seal system according to the present invention in which the drop seal is in its retracted, or first, position. FIG. 2 shows a partial cross-sectional view of the embodiment of FIG. 1 in which the drop seal is in its extended, or second, position. Wall system 20 comprises movable wall panel 22 having first and second opposing wall surfaces 24 and 26, respectively, top edge 28 and bottom edge 30. In this embodiment, reinforcing material 32, such as gyp or drywall, disposed between first and second opposing surfaces 24 and 26 reinforces first and second opposing surfaces 24 and 26 and assists in limiting the amount of sound which may travel through wall panel 22. Additional insulation material (not shown) may be placed between first and second opposing surfaces 24 and 26 for additional sound reduction. Wall panel 22 is connected to dolley 34 which runs within track 36 operatively connected to the room's ceiling (not shown), such as by attachment of track 36 to I-beams within the room's ceiling.

At bottom edge 30 of panel 22 between first and second opposing surfaces 24 and 26 is recess 38 in which drop seal system 40 resides. Drop seal system 40 includes mechanism 42 for sealing wall panel 22 against floor 44. In this embodiment, sealing mechanism 42 includes sealing bracket 48 and sealant strip 50 connected to the lowermost vertical surface of sealing bracket 48, and sealing mechanism 42 is movable between a retracted position wherein sealing mechanism 42 does not engage floor 44 as shown in FIG. 1 and an extended or sealed position wherein sealing mechanism 42 engages floor 44 as shown in FIG. 2. As is described in further detail herein, drop seal system 40 also includes bias means 46 which biases sealing mechanism 42 away from bottom edge 30 of wall panel 22 toward floor 44. In this manner, when sealing mechanism 42 is in its sealed position as illustrated in FIG. 2, it securely engages floor 44 to result in a seal capable of inhibiting the transfer of sound and/or light by eliminating the gap between the bottom edge 30 of panel 22 and floor 44. In this embodiment, sealing mechanism 42 includes seal bracket 48 which extends the width of wall panel 22 and may be made to match first and second opposing surfaces 24 and 26 of wall panel 22 so that seal bracket 48 is aesthetically pleasing. Seal bracket 48 is connected to rubberized sealant strip 50 which extends the width of panel 22. Sealant strip 50 contacts floor 44 when drop seal system 40 is in its extended position to inhibit movement of sealing mechanism 42 and bottom edge 30 of wall panel 22 by inadvertent forces applied against wall panel 22.

Figure 3:
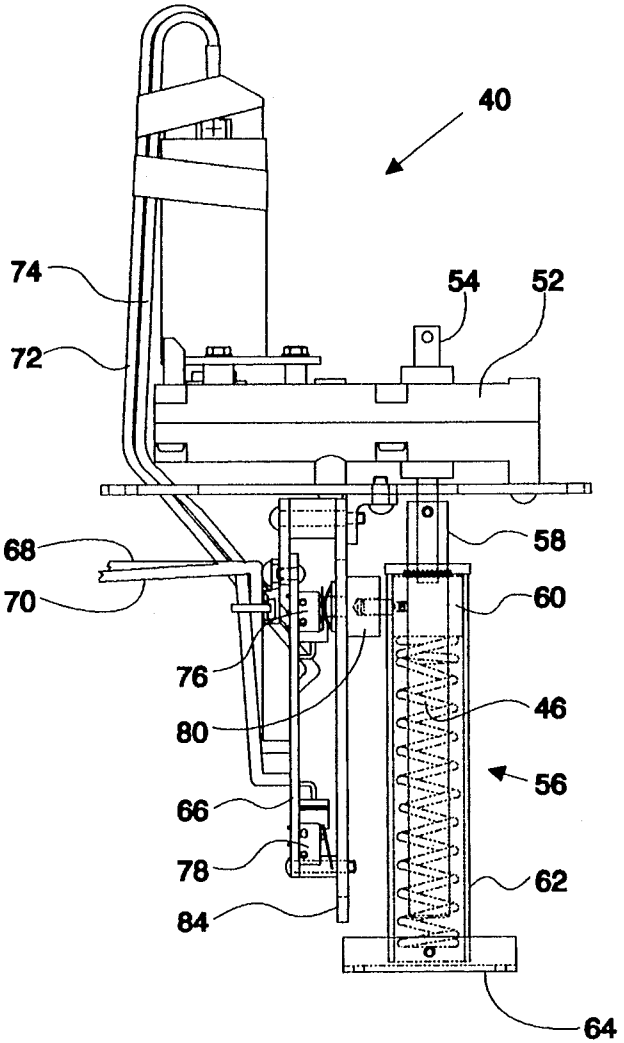
FIG. 3 shows a side view of the drop seal system of the embodiment of FIG. 1.

FIG. 3 shows a side view of the drop seal system of the embodiment of FIG. 1. Drop seal system 40 includes motor 52, such as a 24 VDC reversible gear motor available from Howard Industries, Inc. of Milford, Ill., having motor shaft 54 to which actuator 56, including square nut 60 and square tube 62, is connected via threaded shaft 58. In this embodiment, drop seal system 40 includes threaded rod 58 coupled to motor shaft 54, square nut 60 threadably connected to threaded rod 58, and square tube 62 slidably connected to square nut 60 at one end of square tube 62 such that nut 60 is permitted to slide within tube 62. Square tube 62 is also connected at its other end via connector plate 64 to sealing mechanism 42. Because sealing mechanism 42 is unable to rotate about the longitudinal axis of threaded rod 58, rotation of threaded rod 58 causes nut 60 to traverse the longitudinal axis of threaded rod 58 in a direction dictated by the direction of rotation of threaded rod 58. Bias means 46, in this embodiment, comprises a compression spring fixably attached to nut 60 of actuator 56 at one end and connector plate 64 at its other end.

It will be appreciated by those of skill in the art that because sealing mechanism 42 of drop seal system 40 may be retracted above floor 44, wall panel 22 may be maneuvered by movement of dolley 34 within track 36 without sealing mechanism 42 engaging floor 44 or any covering, such as a carpet, disposed thereon. Therefore, no damage to drop seal system 40 occurs when wall panel 22 is being moved into or out of its desired position.

During operation of drop seal system 40, to move sealing mechanism 42 from its retracted position as illustrated in FIGS. 1 and 3 to its sealed position as illustrated in FIG. 2, power is provided to motor 52 causing rotation of threaded rod 58 to move actuator 56 from the first actuator position shown in FIGS. 1 and 3 to the second actuator position shown in FIG. 2. Specifically, by providing motor 52 with power to rotate motor shaft 54 and threaded shaft 58 in the counterclockwise direction as viewed from above motor 52, nut 60 of actuator 56 is caused to traverse threaded rod 58 from its current position toward sealing means 42 and away from motor 52. Movement of nut 60 causes square tube 62 and sealing means 42 to traverse the longitudinal axis of threaded rod 58 in the same direction as nut 60. Once sealing mechanism 42 initially engages floor 44, nut 60 continues to traverse threaded rod 58 and slides within square tube 62, thereby further compressing spring 46 within square tube 62 until the sealed position is reached. When the sealed position is reached, motor 52 may be disconnected or motor 52 may be caused to operate in the reverse direction.

When operating drop seal system 40 to place sealing mechanism 42 in its extended, or sealed, position, actuator 56 continues to move toward the second actuator position even after sealing mechanism 42 has already engaged floor 44. The application of the biasing force by compression spring 46 against floor 44 enables sealing mechanism 42 to engage floor 44 even if the distance between the ceiling from which wall panel 22 is extended and floor 44 may have increased or decreased since the installation of wall panel 22. Also, regardless of the particular type of surface such as carpet or tile used to cover floor 44 and irrespective of variations in the contour of floor 44, sealing mechanism 42 of the present invention makes sufficient contact with floor 44 to serve as a sound and light barrier. Further, should a force inadvertently be placed on either first or second wall surfaces 24 and 26, as might occur should an individual lean on wall panel 22, rubberized sealant strip 50, together with the biasing force of spring 46 ensures that bottom edge 30 of wall panel 22 will not be displaced in the presence of such a force.

To move actuator 56 from its second position to its first position to thereby retract sealing mechanism 42 away from floor 44, power is provided to motor 52 to cause motor shaft 54 and threaded rod 58 to rotate in a clockwise direction as viewed from above motor 52. This clockwise rotation of threaded rod 58 causes nut 60 to traverse threaded rod 58 toward motor 52 and away from floor 44 until power to motor 52 is disconnected or motor shaft 54 is caused to rotate in the opposite direction. If, when placed in the second actuator position, nut 60 had traversed rod 58 beyond the point at which sealing mechanism 42 just engaged floor 44 so that spring 46 further biased sealing mechanism 42 toward floor 44, movement of nut 60 from this biasing position will not immediately cause sealing mechanism 42 to disengage floor 44 until nut 60 has moved a sufficient distance along threaded rod 58 toward motor 52 to relieve the further compression of spring 46. This sufficient distance occurs when nut 60 reaches the end of square tube 62. Thereafter, further movement of nut 60 away from floor 44 causes sealing mechanism 42 to move away from floor 44 into recess 38 of wall panel 22.

It will be appreciated that compression spring 46 translates the movement of actuator 56 from its first position to its second position into movement of sealing mechanism 42 from its retracted position to its sealed position. Other mechanisms, such as a threaded screw, for example, may by utilized for the same purpose.

In the embodiment of FIGS. 1–3, power from a power supply is provided to motor 52 through circuit board 66. Specifically, power supply wires 68 and 70 are electrically connected to circuit board 66 (see FIGS. 4–5) and motor wires 72 and 74 electrically connect circuit board 66 to motor 52. Circuit board 66 has first and second limit switches 76 and 78, respectively, thereon. Actuation of limit switches 76 and 78 will be explained in further detail herein, but in most general terms, first and second limit switches 76 and 78 serve as an indicator that actuator 56 has reached the first or second actuator positions, respectively. In this embodiment, block 80 (FIG. 3) is connected to actuator 56. Specifically, block 80 is connected to nut 60 and is slidably movable with respect to square tube 62 as the connection of nut 60 to square nut 60 resides within a slot (not shown) in tube 62. Block 80 is also slidably movable within slot 82 (see FIG. 4) of circuit board bracket 84 to which circuit board 66 is attached such that when actuator 56 is in its first position, block 80 actuates first limit switch 76 and when actuator 56 is in its second position, block 80 actuates second limit switch 78.

Figure 5:
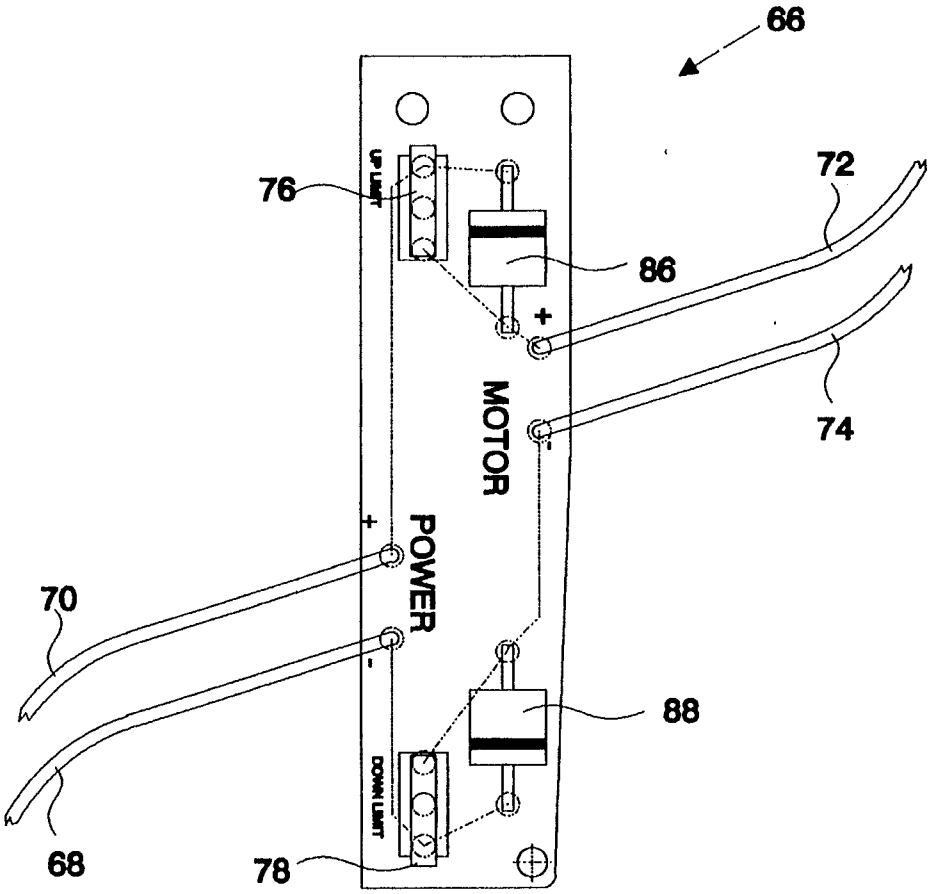
FIG. 5 shows a front view of the printed circuit board used in conjunction with one embodiment of the drop seal system according to the present invention.

Referring now to FIG. 5, there is shown a front view of the printed circuit board used in conjunction with one embodiment of the drop seal system according to the present invention. First and second limit switches 76 and 78, electrically connected to first and second silicon rectifiers 86 and 88, respectively, as shown, reside on circuit board 66. Power supply wires 68 and 70 and motor wires 72 and 74 are electrically connected to circuit board 66 as shown.

As previously mentioned, circuit board 66 provides a means for controlling the power provided to motor 52 of drop seal system 40. Specifically, to move sealing mechanism 42 into its extended position from its retracted position, power is supplied to motor 52 to rotate rod 58 in the counterclockwise direction until block 80 engages and activates second limit switch 78. Activation of second limit switch 78 causes power to motor 52 to be disconnected. At this point, actuator 56 is in its second position and sealing mechanism 42 is in its extended, or sealed, position. To move sealing mechanism 42 to its retracted position from its extended position, power is supplied to motor 52 to rotate rod 58 in the clockwise direction until block 80 engages first limit switch 76. Activation of first limit switch 76 causes power to motor 52 to be disconnected. At this point actuator 56 is in its first position and sealing mechanism 42 is in its retracted position.

It will be appreciated by those of skill in the art that implementation of silicon rectifiers 86 and 88 on circuit board 66 allows circuit board 66 to be serviced with only two power supply wires 68 and 70. Thus, as illustrated in FIG. 6, the wiring required to service drop seal system 40 of the present invention only includes two power supply wires connected to motor 52 which is far less bulky then would be should four wires be required.

It will be further appreciated that the drop seal system of the present invention can be made to accommodate various average distances between the floor and the bottom edge of the movable wall panel. If, for example, the distance between first and second limit switches 76 and 78, and hence the distance between the first and second actuator positions, is three (3) inches, compression spring 46 may bias sealing mechanism 42 with sufficient force to result in a good seal when the sealing mechanism 42 is extended just beyond bottom edge 30 of wall panel 22 to slightly less than three (3) inches beyond bottom edge 30 of wall panel 22, depending on the strength of spring 46. This may be, for example, from 0.5 inches to 2.5 inches below bottom edge 30 of wall panel 22, thereby allowing wall panel 22 to be suspended above floor 44 at a height 2.5 inches above the lowest point on floor 44. Such an embodiment therefore accommodates variations in the floor's contour of up to two (2) inches. If the distance between the room's ceiling and floor is known or suspected to deviate by up to one (1) inch, such a drop seal system could still accommodate variations of one (1) inches in the floor's contour. Alternately expresses, if the distance between the first and second actuator positions is three (3) inches and bottom edge 30 of wall panel 22 is set to be two (2) inches above floor 44, sealing mechanism 42 may be raised 1.5 inches or lowered 0.5 inches and still exert sufficient biasing force against floor 44.

Figure 6:
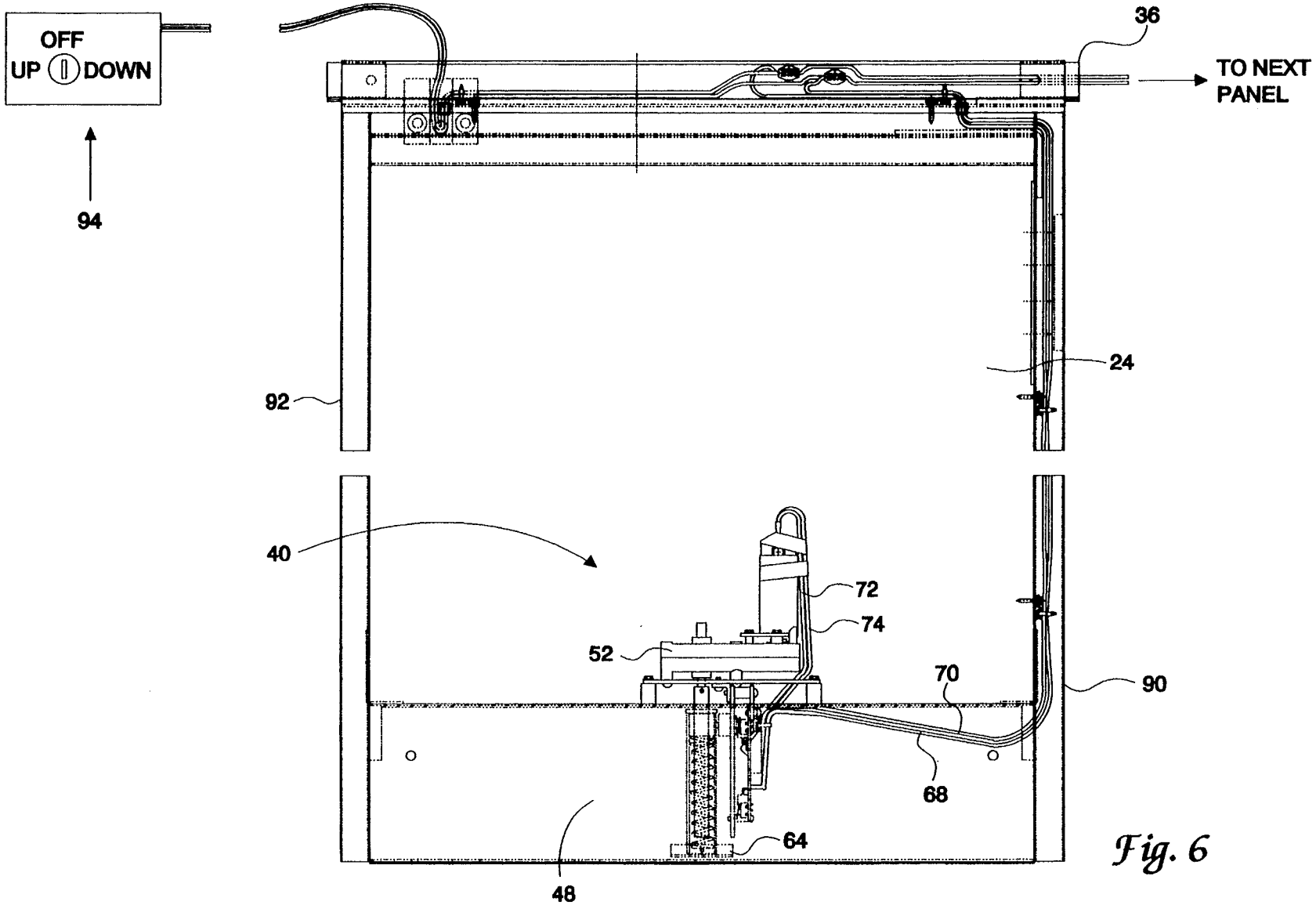
FIG. 6 shows a side view of one embodiment of the drop seal system, including the wiring for the motor of the drop seal system according to the present invention as installed in the trailing wall panel of an operable wall panel system.

FIG. 6 shows a side view of one embodiment of the drop seal system, including the wiring for the motor of the drop seal system according to the present invention as installed in the trailing wall panel of an operable wall panel system. In this embodiment, wall panel 22 includes leading edge 90 and trailing edge 92 and power supply wires 68 and 70 extend from drop seal system 40 to leading edge 90 of wall panel 22. Leading edge 90 includes a channel therein for the running of power supply wires 68 and 70 therethrough. Power supply wires 68 and 70 are then run through track 36 and are of sufficient length to remain connected to the power supply (not shown) and power switch 94 when the wall panel system is in its extended and retracted positions. Power supply wires 68 and 70 are also electrically connected to the next or adjacent wall panel, as illustrated, for the provision of power to the drop seal system disposed within that adjacent panel. In this embodiment, power switch 94 comprises a key switch having OFF, UP and DOWN positions such that drop seal system 40 may be moved to its extended or retracted positions by placement of power switch 94 in the DOWN or UP positions, respectively.

It will be appreciated by those of skill in the art that there are no components of drop seal system 40 which extend beyond the external boundaries of wall panel 22. Drop seal system 40 is encased with wall panel 22 so as to avoid damage to the components of drop seal system 40.

Figure 7:
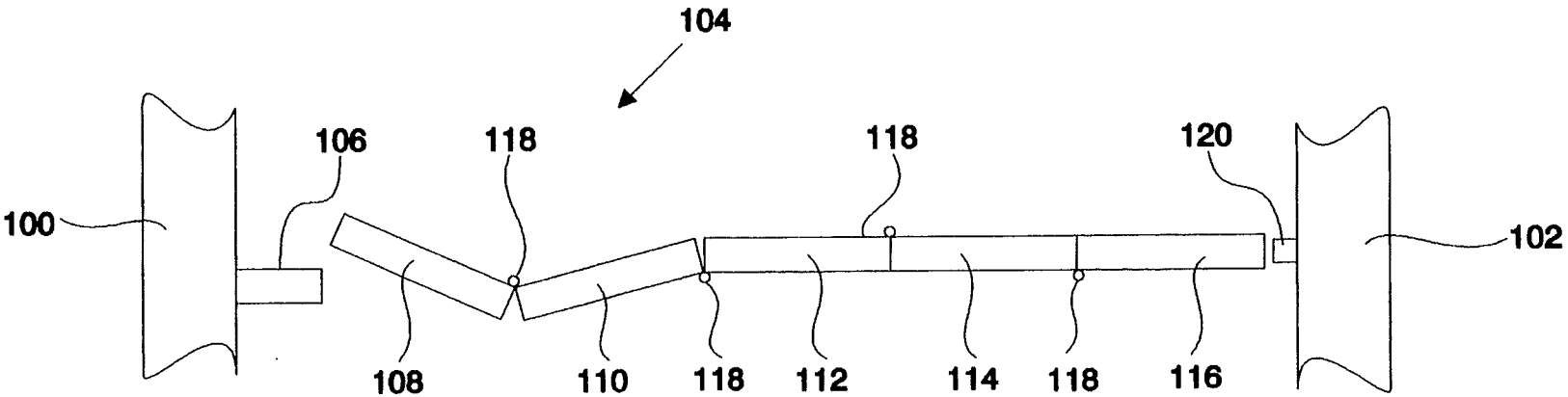
FIG. 7 shows a diagrammatic top view of multiple hingedly connected wall panels movable between two rigid walls in which each wall panel includes a drop seal according to the present invention and in which a limit switch resides on the leading wall for determining when the wall panels are fully extended between the two rigid walls.

Referring now to FIG. 7, there is shown a diagrammatic top view of multiple hingedly connected wall panels movable between two rigid walls in which each wall panel includes a drop seal according to the present invention and in which a limit switch resides on the leading wall for determining when the wall panels are fully extended between the two rigid walls. Disposed between trailing wall 100 and leading wall 102 is movable wall panel system 104. Wall panel system 104 includes jamb 106, fixably attached to trailing wall 100 and wall panels 108, 110, 112, 114 and 116, hingedly connected to each other via hinges 118 as shown. Wall panels 108, 110, 112, 114 and 116 each include drop seal system 40 and are collectively driven between trailing wall 100 and leading wall 102 by a motor to push or pull leading panel 116 as is known in the art. In this embodiment, limit switch 120 serves as a means for determining that leading panel 116 has engaged leading wall 102. Thus, the use of limit switch 120 provides for the automatic operation of the drop seal system disposed within wall panels 108, 110, 112, 114 and 116. Specifically, when limit switch 120 is activated, wall panel system 104 is fully extended between trailing wall 100 and leading wall 102 indicating that the drop seals within wall panels 108, 110, 112, 114 and 116 may be lowered to their extended positions. Before retracting wall panels 108, 110, 112, 114 and 116, the drop seals should be retracted.

It will be appreciated by those of skill in the art that various electronic circuitry configurations may be utilized to start either the extension or retraction of the drop seals of the system. For example, the electronics associated with driving the movable wall panels may be coupled with the electronics supporting the drop seals such that drop seals are not extended during movement of the panels or so that the drop seals are retracted prior to movement of the wall panels toward their retracted position.

It will be further appreciated that the drop seal system of the present invention may be used with operable wall panels which are manually moved into position along the track from which the panels are suspended. The wall panels of the operable wall system need not be hingedly connected to each other nor electrically powered to be considered within the scope of the invention as presented herein.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A drop seal assembly for a movable wall panel, the wall panel being situated in a room having a ceiling and a floor such that the wall panel is supported from the ceiling and is suspended above the floor, the drop seal assembly comprising:

a motor;

an actuator operatively connected to the motor, the actuator being selectively movable responsive to operation of the motor between a first position and a second position;

retractable sealing means for providing a seal between the wall panel and the floor, the sealing means being movable between a retracted position above the floor and a sealed position in sealing engagement with the floor; and means for translating movement of the actuator from the first position to the second position into movement of the retractable sealing means from the retracted position to the sealed position.

2. The drop seal assembly of claim 1, wherein the translating means comprises bias means for biasing the sealing means against the floor when the actuator is in the second position.

3. The drop seal assembly of claim 2, wherein the bias means comprises a compression spring having two ends, the compression spring being connected at one end to the actuator and at the other end to the sealing means.

4. The drop seal assembly of claim 1, in which the drop seal assembly includes a threaded shaft, the threaded shaft being rotatable responsive to operation of the motor; and wherein the actuator includes a nut threadably engaged with the shaft and axially movable along the threaded shaft between the first and second positions upon rotation of the shaft.

5. The drop seal assembly of claim 4, wherein the actuator further comprises a tube having two ends, the tube being slidably connected at one end to the nut and connected at the other end to the sealing means.

6. The drop seal assembly of claim 1, further including first and second limit switches, the first limit switch being actuable when the actuator reaches the first position to disconnect the motor and thereby prevent movement of the actuator beyond the first position; the second limit switch being actuable when the actuator reaches the second position to disconnect the motor and thereby prevent movement of the actuator beyond the second position.

7. The drop seal assembly of claim 1, further comprising means for selecting the position of the actuator, the selecting means in electrical connection with the motor such that selection of a position of the actuator causes activation of the motor to move the actuator to the selected position.

8. The drop seal assembly of claim 1, wherein the retractable sealing means comprises a seal bracket and a sealant strip, the seal bracket and sealant strip being sized to extend the width of the wall panel, the seal bracket having a lowermost vertical surface and the sealant strip being attached to the lowermost vertical surface such that the sealant strip engages the floor when the sealing means is in the sealed position.

9. The drop seal assembly of claim 8, wherein the sealant strip is a rubberized sealant strip.

10. The drop seal assembly of claim 1, wherein the motor comprises a reversible motor.

11. A movable wall panel system for use in a room having a floor and a ceiling, the movable wall panel system comprising:

a least one wall panel having first and second opposing surfaces, having a top edge and a bottom edge, and situated in the room such that the panel is supported from the ceiling and suspended above the floor; and a drop seal assembly for the movable wall panel, the drop seal system disposed between first and second opposing surfaces of the wall panel, the drop seal assembly comprising a motor, an actuator operatively connected to the motor, the actuator being selectively movable between a first position and a second position, retractable sealing means for providing a seal between the wall panel and the floor, the sealing means being movable between a retracted position above the floor and a sealed position in sealing engagement with the floor, and means for translating movement of the actuator from the first position to the second position into movement of the retractable sealing means from the retracted position to the sealed position.

12. The system of claim 11, wherein the translating means comprises bias means for biasing the sealing means against the floor when the actuator is in the second position.

13. The system of claim 12, wherein the bias means comprises a compression spring having two ends, the compression spring being connected at one end to the actuator and at the other end to the sealing means.

14. The system of claim 11, in which the drop seal assembly includes a threaded shaft, the threaded shaft being rotatable responsive to operation of the motor; and wherein the actuator includes a nut threadably engaged with the shaft and axially movable along the threaded shaft between the first and second positions upon rotation of the shaft.

15. The system of claim 14, wherein the actuator further comprises a tube having two ends, the tube being slidably connected at one end to the nut and connected at the other end to the sealing means.

16. The system of claim 11, further including first and second limit switches, the first limit switch being actuable when the actuator reaches the first position to disconnect the motor and thereby prevent movement of the actuator beyond the first position; the second limit switch being actuable when the actuator reaches the second position to disconnect the motor and thereby prevent movement of the actuator beyond the second position.

17. The system of claim 11, further comprising means for selecting the position of the actuator, the selecting means in electrical connection with the motor such that selection of a position of the actuator causes activation of the motor to move the actuator to the selected position.

18. The system of claim 11, wherein the retractable sealing means comprises a seal bracket and a sealant strip, the seal bracket and sealant strip being sized to extend the width of the wall panel, the seal bracket having a lowermost vertical surface and the sealant strip being attached to the lowermost vertical surface such that the sealant strip engages the floor when the sealing means is in the sealed position.

19. The system of claim 18, wherein the sealant strip comprises a rubberized sealant strip.

20. The system of claim 11, wherein the motor comprises a reversible motor.

21. A drop seal assembly for a movable wall panel, the wall panel being situated in a room having a ceiling and a floor such that the panel is supported from the ceiling and suspended above the floor, the drop seal assembly comprising:

a motor;

an actuator operatively connected to the motor, the actuator being selectively movable responsive to operation of the motor between a first position and a second position;

retractable sealing means for providing a seal between the wall panel and the floor, the sealing means being movable between a retracted position above the floor and a sealed position in sealing engagement with the floor; and bias means for translating the movement of the actuator from the first position to the second position into movement of the retractable sealing means from the retracted position to the sealed position, the bias means biasing the sealing means against the floor when the actuator is in the second position.

* * * * *